US006932349B2

(12) United States Patent
Coppola

(10) Patent No.: US 6,932,349 B2
(45) Date of Patent: Aug. 23, 2005

(54) SEALING SYSTEM FOR GAS TURBINE

(75) Inventor: Alessandro Coppola, Prato (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 10/312,717

(22) PCT Filed: Jun. 20, 2001

(86) PCT No.: PCT/EP01/07024

§ 371 (c)(1),
(2), (4) Date: Jul. 28, 2003

(87) PCT Pub. No.: WO02/01046

PCT Pub. Date: Jan. 3, 2002

(65) Prior Publication Data

US 2004/0100034 A1 May 27, 2004

(30) Foreign Application Priority Data

Jun. 29, 2000 (IT) ..... MI2000A1461

(51) Int. Cl.[7] ..... F01D 11/02

(52) U.S. Cl. ..... 277/409; 277/411; 277/412; 277/431

(58) Field of Search ..... 277/409, 411, 277/412, 431

(56) References Cited

U.S. PATENT DOCUMENTS 4,193,603 A 3/1980 Sood

FOREIGN PATENT DOCUMENTS

GB 852805 A 11/1960

*Primary Examiner*—Enoch Peavey
(74) *Attorney, Agent, or Firm*—Nixon & Vanderhye P.C.

(57) ABSTRACT

A system (10) for sealing and pressurization for the support cushion (24) of a gas turbine (20), wherein the gas turbine (20) is provided with a compressor (21), with which there is associated an inner barrel (23), and the support cushion (24) is in turn provided with seals (38, 39) relative to the axis of the compressor (21), and has at least one pipe (33) for the venting discharge. The air is fed into the inner barrel (23), using the venting piping (33) of the support cushion (24), such as to create a flow of air, which starts from an intermediate stage of the compressor (21), and goes towards the inner barrel (23).

6 Claims, 5 Drawing Sheets

VALVE
60
ACTUATOR
62
42
33
10
24
38
37
39
38
37
39
34
36
24
35

SEALING SYSTEM FOR GAS TURBINE

The present application is a U.S. National Phase (371 application) of PCT/EP01/07024.

The present invention relates to a system for sealing and pressurisation for the support cushion of a gas turbine.

As is known, gas turbines comprise a compressor, to which air taken from the external environment is supplied, such as to pressurise the compressor.

The compressed air passes into a series of combustion chambers, which end in a nozzle, into each of which an injector supplies fuel, which is mixed with the air, in order to form a combustible air mixture to be burnt.

The turbine transforms the enthalpy of the burnt gases in the said combustion chamber into mechanical energy which is available to a user.

The present invention relates in particular to the area relative to the discharge of the gas turbine compressor.

In order to introduce the technical problems which are solved by the present invention, it should be noted that the continual quest for increases in the performance of gas turbines necessitates optimisation of all the flows inside the turbine engines.

In particular, since the air which is obtained from the compression stages has been processed with a considerable thermodynamic increase, it should be used as far as possible for combustion, instead of for functions of cooling and confinement, which are however necessary in the most critical hot areas.

The problem which arises in this context is thus that of correct metering of the air obtained from the compression stages in the various areas, taking into account the fact that the amount of air required varies according to the operating conditions, the age and degree of wear or dirtiness of the turbine engine and its components, and the dimensional variations of the components during the transient phases.

In fact, if there is an insufficient flow of air, in the best of cases the consequences are a considerable reduction of the life of the machine components, with the possibility of resulting blade failure and fires.

At this point it should be noted that, incidentally, these factors can contribute towards increasing the costs for the users, and that it is important to face the problem of correct metering of air in the case of uprates of machines which are already in existence.

In order better to understand the technical problems involved in the present invention, reference is made firstly to FIGS. 1–3, which represent respectively a view in cross-section of a gas turbine according to the known art, indicated as a whole by the reference number 20, an enlarged view of the discharge area of the compressor 21 of the gas turbine 20, and a detail of the area relating to the support cushion 24 of the turbine.

More particularly, FIG. 1 shows a gas turbine 20, which is provided with a compressor 21, with which there is associated an inner barrel 23, and a support cushion 24; FIG. 1 also shows inter alia the rotors 25 and 26 of the turbine 20.

In practice, FIG. 2 shows the conventional solution for control of the cooling flows of the gas turbine. 20, which can include fixed holes 22 in the body 50 of the inner barrel 23; arrows also indicate the directions of the cooling flows.

If FIG. 2 is examined in greater detail, there can be seen the stator 27 and the blades 28, which belong to the final stages of the compressor 21, the discharge diffuser 29 of the compressor 21, the venting discharge 33, which is associated with the support cushion 24, and the air seals 30 and 38 of the inner barrel 23; FIG. 2 also shows a portion of the rotor 32.

FIG. 3 shows in detail the area relating to the support cushion 24 of the turbine, in which the flows of air according to the known art are indicated by arrows.

The solutions which are used at present for correct metering of the flows of air which are designed for cooling and sealing, comprise specific definition of apertures in the piping and in the feed ducts, and determination of the dimensions of the play between the rotary units and the labyrinth seals provided on the additional stator components of the machine.

The apertures and labyrinth seals (see FIGS. 2–3) are thus interdependent from the design point of view, and are determined unambiguously during the stage of development of the prototype, in order to be able to control extreme and off-design situations.

This means that these regulations and margins thus remain fixed by the builder during the assembly stage.

A direct consequence of this situation is that it is therefore impossible to correct the amount of air which is fed into the critical areas of the turbine continuously, according to the actual instantaneous requirements which are associated with substantial variability of the ambient and operative conditions.

However, the requirement for increases in the performance of the machines by the clients is now making it necessary to reduce the flows of air to the essential minimum, using increasingly high-performance seals, and this worsens the handicap of having pre-determined regulations which are not flexible.

In particular, there is a tendency to reduce the amount of air which escapes from the compressor 21, towards the innermost portions of the machine 20 (FIGS. 1–3), in particular in the area inside the inner barrel 22.

This air, which passes via a first labyrinth seal barrier 38, then escapes from the venting of the support cushion 24 of the compressor 21, through the front gap of the first turbine blade, through the labyrinth seal provided with angel wings on the shanks of the vanes, and the stationary seals which are fitted onto the stator.

The function of this air is thus to seal against the oil vapours in the cushion 24, to seal against the hot gases in the turbine 20, to cool the turbine disc, and to remove the heat produced by ventilation friction inside the inner barrel 23.

It is therefore apparent that the metering of this flow is critical with reference to its effect on the overall reliability, and on performance in terms of output.

It is thus appropriate to implement regulation systems which are actuated directly in real time, by means of the control panel of the machine, such as to constitute a self-adapting integrated system.

In the conventional air control system, all of the air which is necessary for cooling of the area contained in the inner barrel 23, the intermediate (compressor-turbine) shaft. 34, the cushion 24 and high-pressure turbine rotor, plus the air which is necessary to seal against oil and vapours of the cushion 24, is obtained via the labyrinth seal which blocks the interface of the inner barrel/intermediate shaft flange.

The flow obtained from the last stage of the compressor 21 is then admitted into the area of the inner barrel 23 via this labyrinth seal, and is then subdivided into two flows, one which laps the turbine rotor, and then escapes, sealed against the hot gas channel, and one which advances to the outer labyrinth seal of the support cushion 24, and then escapes, mostly in the venting piping 33, with the remaining amount going to the oil discharge of the support cushion 24 in the collection tank 35 beneath, having passed through an inner labyrinth seal 36, which is sealed against oil and vapours.

The amount of air which escapes from the ventilation duct 33 of the cushion 24 is then directed towards the rear space of the low-pressure turbine, which has cooling functions (as in the case of circuits of type FR3.2, optionally added to other air bled to the compressor), or towards the outer environment.

In this type of "fixed" circuit, the distribution of the flows is closely associated with the play of the various labyrinth seals, and their variation in use, which clearly does not depend on regulation logic, but on wear and dimensional variations of the components, which is difficult to foresee with the necessary accuracy.

The object of the present invention is thus to provide a system for sealing and pressurisation for the support cushion of a gas turbine, which permits regulation which is customised and continuous over a period of time, without needing to stop the machine.

In particular, the object is to obtain an air feed which takes place continuously, according to the actual requirements which arise, moment by moment, in the gas turbine.

Another object of the invention is to provide a system for sealing and pressurisation for the support cushion of a gas turbine, which makes possible a longer service life of the components of the gas turbine on which it is fitted.

Another object of the invention is to provide a system for sealing and pressurisation for the support cushion of a gas turbine, which avoids any removal of significant components of the turbine engine, whilst making it possible to vary the flow of air to the inner barrel.

A further object of the invention is to provide a system for sealing and pressurisation for the support cushion of a gas turbine, which does not require radical re-design of the machine, but can be adapted easily and economically also to the existing machines.

Another object of the invention is to provide a system for sealing and pressurisation for the support cushion of a gas turbine, which is substantially simple, safe and reliable.

These objects and others are achieved by a system for sealing and pressurisation for the support cushion of a gas turbine, wherein the said gas turbine is provided with a compressor, with which there is associated an inner barrel, and the said support cushion, which in turn is provided with seals relative to the axis of the said compressor, has at least one pipe for the venting discharge, characterised in that the air is fed into the said inner barrel, using the said venting piping of the support cushion, such as to create a flow of air, which starts from an intermediate stage of the compressor, and goes towards the said inner barrel.

According to a preferred embodiment of the present invention, a first portion of the overall air flow is conveyed into the cavity of the inner barrel by means of an opening provided in the said venting pipe, and a second portion of the overall air flow passes through the outer labyrinth seal of the cushion, all in order to create an air circuit in the reverse direction.

According to a preferred embodiment of the present invention, the said support cushion, in cooperation with its own labyrinth seals, makes it possible to define the said air circuit in an inverse direction, by means of the presence of a valve, which can choke the air, and an electromechanical, actuator which is provided with a valve position sensor.

In addition, the automated valve is controlled directly from the machine control panel, such as to correspond virtually instantaneously to the variations of functional conditions, according to an algorithm appropriate for processing of the data obtained from the standard sensor equipment supplied together with the gas turbine.

Finally, the cooling air which is used is bled to the $10^{th}$ stage of the compressor, and the second turbine disc is cooled directly by the delivery of the bleeding to the said $10^{th}$ stage.

Further characteristics of the invention are defined by the claims attached to the present patent application.

Further objects and advantages of the present invention, and its specific structural and functional characteristics, will become apparent from examining the following description and the drawings attached to it, which are provided purely by way of explanatory, non-limiting example, and in which.

Figure 1:
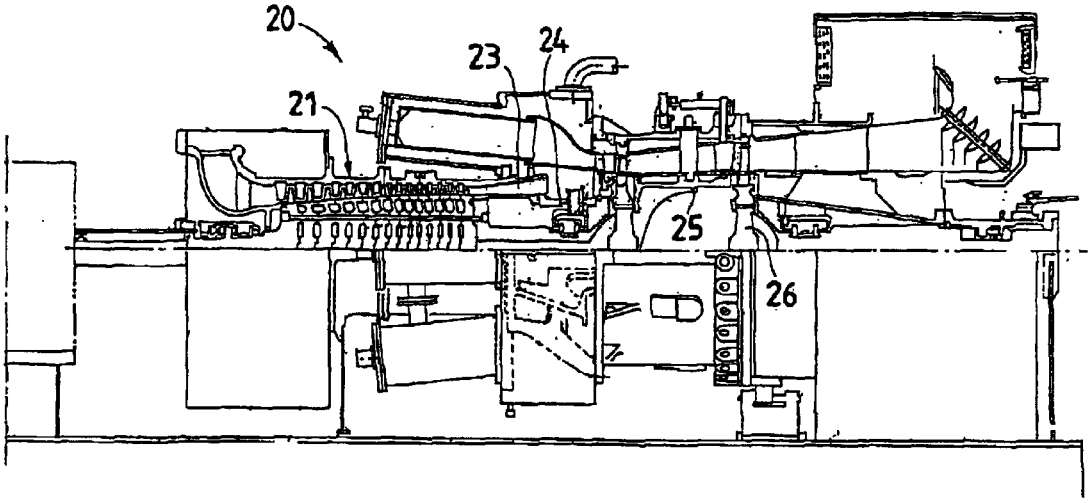
Fig.1 PRIOR ART
FIG. 1 represents a view in cross-section of a gas turbine, according to the known art.
Figure 2:
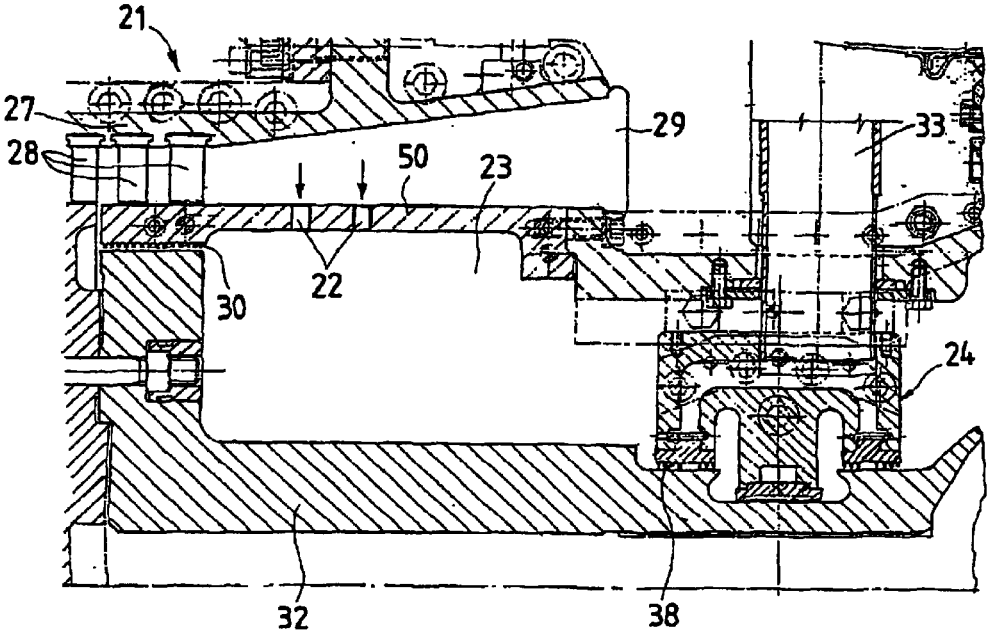
Fig.2 PRIOR ART
FIG. 2 represents a view in cross-section of an enlargement of the discharge area of the gas turbine compressor in FIG. 1.
Figure 3:
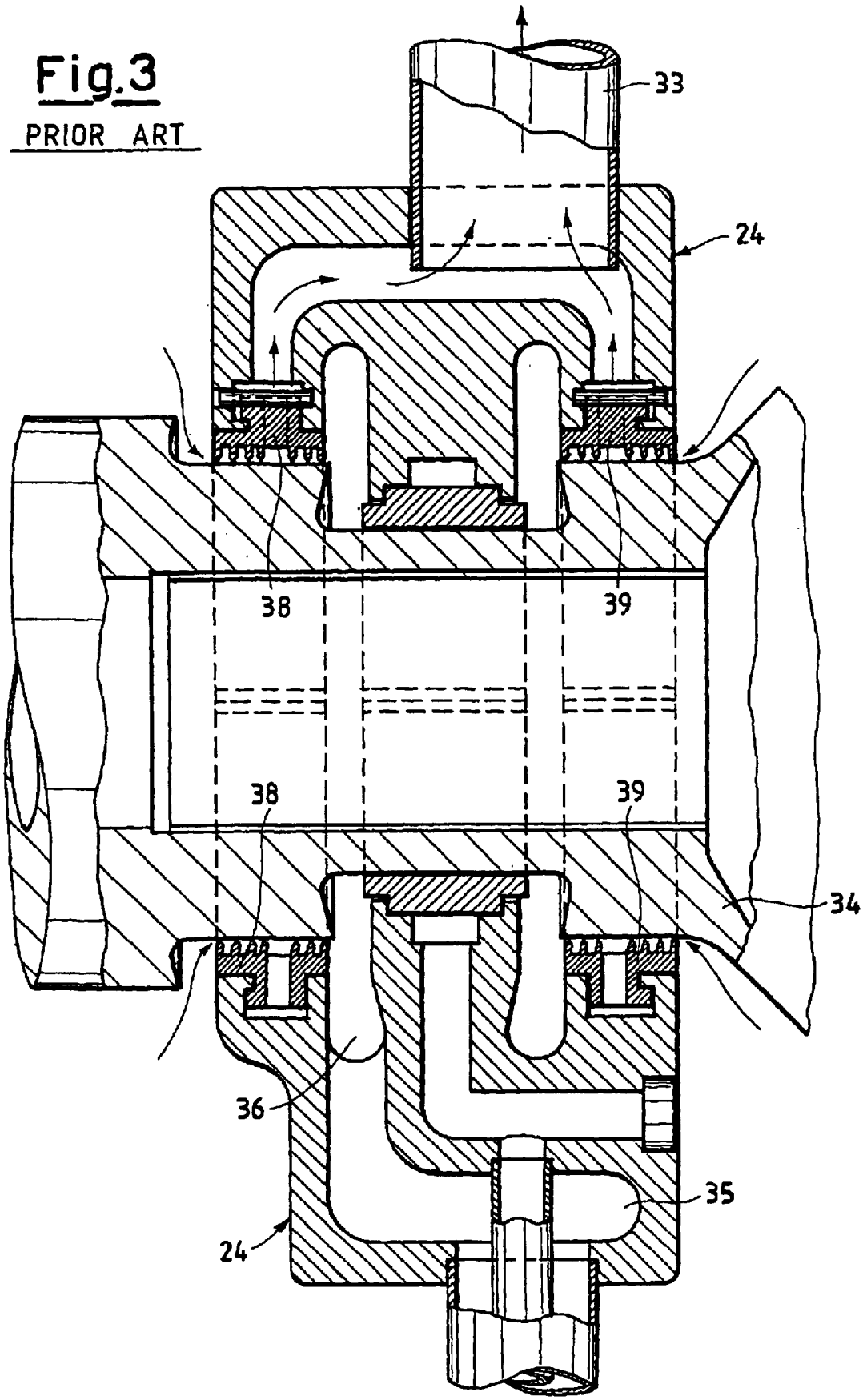
Fig.3 PRIOR ART
FIG. 3 represents a view in cross-section of a detail of the area relative to the support cushion of the turbine, with the flows of air according to the known art.
Figure 4:
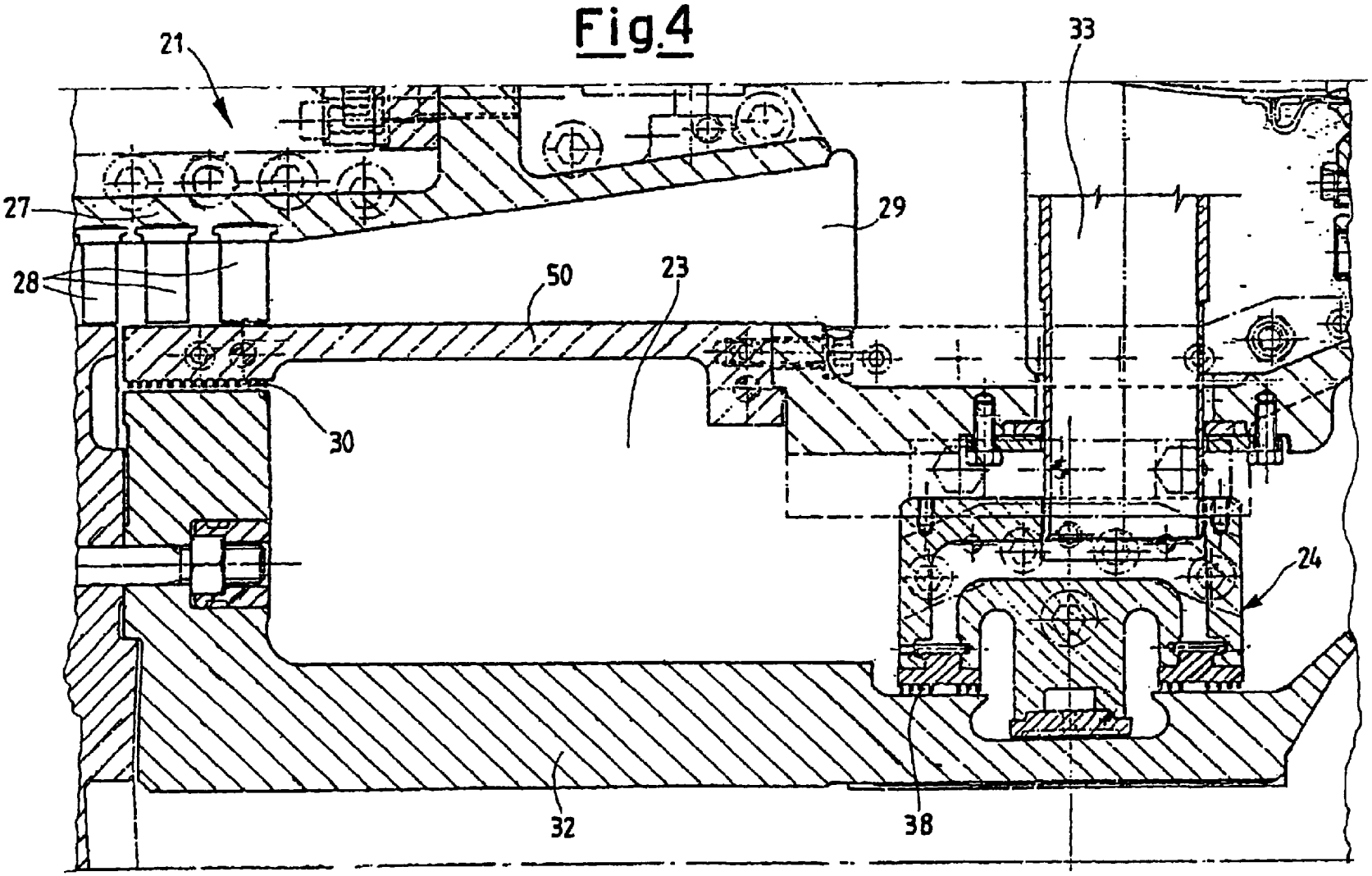
FIG. 4 represents a view in cross-section of the system for sealing and pressurisation for the support cushion of a gas turbine, according to the present invention.
Figure 5:
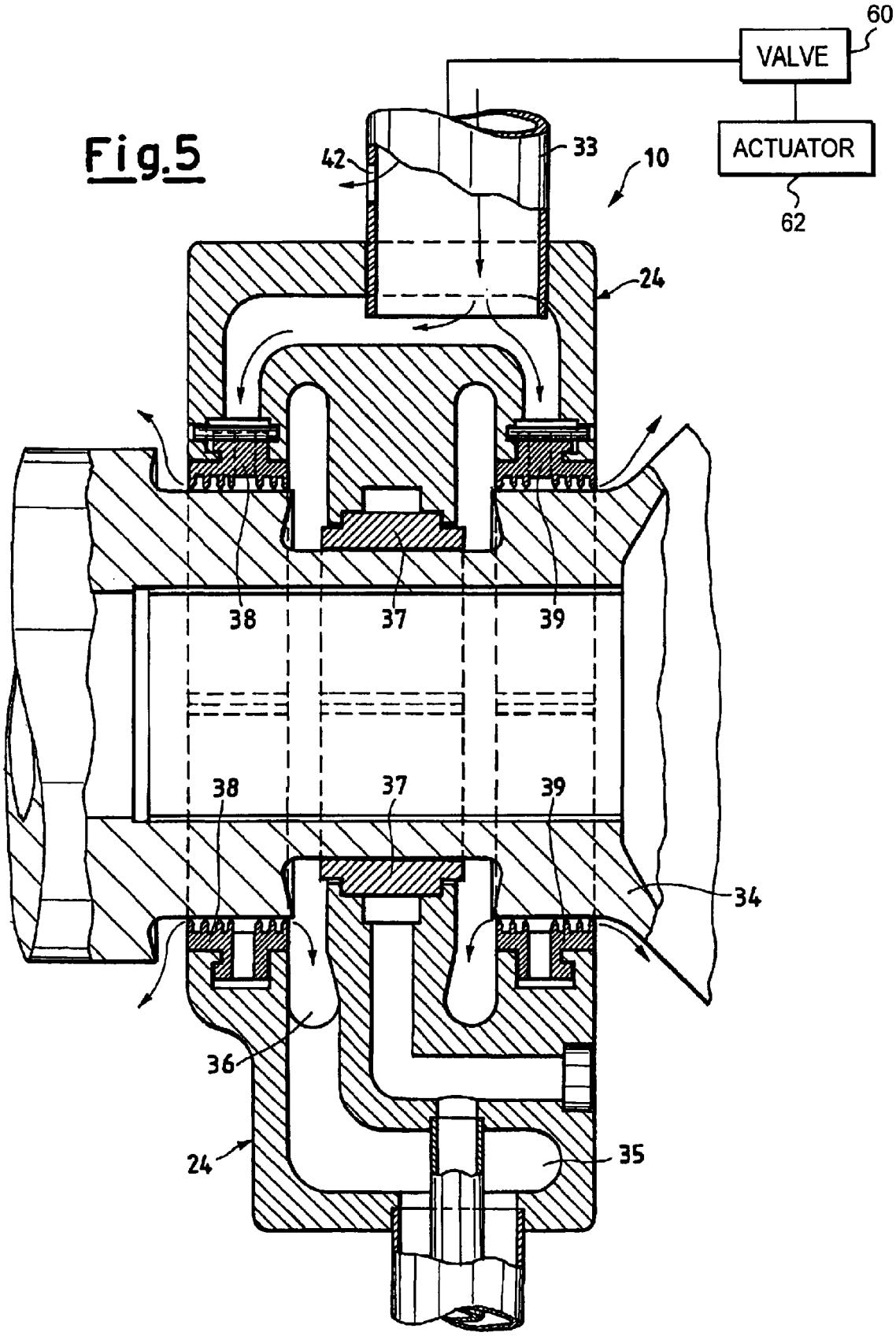
FIG. 5 represents a view in cross-section of a detail of the area relative to the support cushion of the turbine, with the flows of air according to the present invention.
Figure 7:
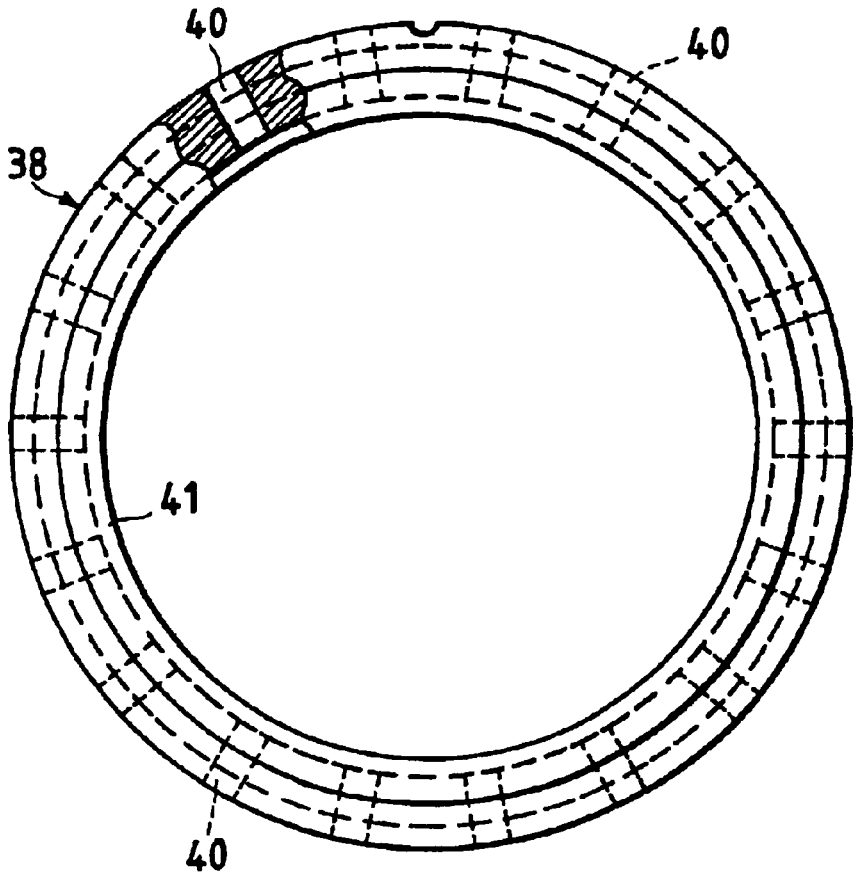
FIG. 7 represents a plan view of the labyrinth seal for sealing of the support cushion.

With particular reference at this point to FIGS. 4–7, the system for sealing and pressurisation according to the present invention, for the support cushion of a gas turbine, is indicated globally by the reference number 10.

In the system for sealing and pressurisation 10 according to the present invention, the air is fed into the inner barrel 23, using the venting piping 33 of the cushion 24, with a flow which is inverse in comparison with that according to the known art, thus reducing as far as possible the flow of air in the labyrinth seal.

The overall flow of air is thus conveyed back into the cavity, mainly via the opening, and partially through the outer labyrinth seal of the cushion 24, also with a flow which is reduced as far as possible, and in a direction which is the inverse of that of the original configuration.

The remaining portion of the air which enters the casing of the cushion 24 thus enters into the area of the liners 37, consequently avoiding leakages of oil and vapours.

It can therefore be noted that the support cushion 24, in cooperation with he labyrinth seals 38 and 39, makes it possible to define a new air circuit, by means of the presence of the air-choking choking valve 60 and an electromechanical actuator 62 with a valve position sensor.

The opening of the venting piping 34 of the support cushion 24 is also provided, with the hole 42, and with the form and flanging of the present piping for implementation of the circuit according to the invention.

The system is designed to have automated control of the valve, directly from the machine control panel, such as to correspond virtually instantaneously to the variations of functional conditions, according to an algorithm appropriate for processing of the data obtained from the standard sensor equipment supplied together with the gas turbine.

Figure 6:
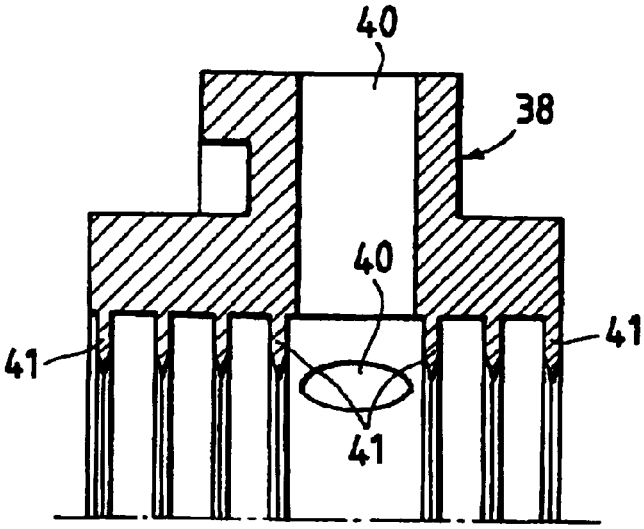
FIG. 6 represents a view in cross-section of a detail relative to the labyrinth seal for sealing of the support cushion.

FIG. 6 also represents a view in cross-section of a detail relating to the labyrinth seal for sealing of the support cushion 24, with the air passage hole 40 and the sealing toothing 41.

The description provided makes apparent the characteristics and advantages of the system according to the invention, for sealing and pressurisation for the support cushion of a gas turbine.

The following considerations and comments are now provided, such as to define the said advantages more clearly and accurately.

The solution proposed is provided in order to be able to vary the flow of air supplied in the inner barrel, without needing to replace or dismantle any significant component of the turbine engine, but simply by acting without solution of continuity on an appropriate choking valve, which is supplied in the innovative system for cooling and venting previously described.

This is such as to permit customised regulation, continuously over a period of time, without a machine stoppage.

The major advantage consists of being able to seal the interface between the inner barrel and the axis of the compressor in the best possible way, optionally using the new seals of the brush type, thus, in order to regulate the flow of air necessary, being able to be completely independent from dimensional variations over a period of time.

It is therefore possible to seal in the best possible way also the outer labyrinth seal of the air seal on the support cushion 24, additionally counting on the fact that since the channel contained between the inner and outer labyrinth seal is pressurised, it makes it possible to limit the risk of contamination of the outer seal by contact with oil.

The air which is necessary in order, by ventilation, to dispose of the heat produced by the shaft, and which then laps the turbine disc, and finally seals the hot gas path, is completely and finely controlled by the external valve.

The tuning is therefore assured and continuous throughout the period of operation of the turbine engine, and in addition the cooling air used is colder than that which is bled to the $15^{th}$ stage (obtained from the $10^{th}$ stage), thus permitting a further reduction.

The second turbine disc is cooled directly by the delivery of the bleeding to the $10^{th}$ stage.

The theoretical and experimental results have been so satisfactory, that they show that the system can be used on widely distributed gas turbines.

It is apparent that many variations can be made to the system according to the present invention, for sealing and pressurisation for the support cushion of a gas turbine, which is the subject of the present invention, without departing from the principles of novelty which are inherent in the inventive concept illustrated.

Finally, it is apparent that, in the practical embodiment of the invention, any materials, forms and dimensions can be used for the details illustrated, according to requirements, and can be replaced by others which are equivalent from a technical point of view.

The scope of the invention is defined by the attached claims.

What is claimed is:

1. A sealing and pressurization system for a gas turbine including a compressor comprising:

an inner barrel;

a support cushion for a shaft of the turbine and having seals about said shaft;

said cushion including at least one vent pipe for flowing air from an intermediate stage of said compressor into said inner barrel;

said vent pipe having a lateral opening upstream of said seals for flowing a first portion of said air into said inner barrel;

at least one of said seals having a passage for flowing a second portion of said air from said vent pipe into said barrel.

2. A system according to claim 1 wherein said seals have inner and outer axially spaced seal portions relative to a liner about said shaft enabling said second portion of said air to flow into the inner barrel through said outer seal of said cushion.

3. A system according to claim 2 wherein said outer seal comprises a labyrinth seal.

4. A system according to claim 1 including a valve for controlling air supplied through said vent pipe and an actuator for said valve for varying the flow of air to said inner barrel.

5. A system according to claim 1 wherein said seals have inner and outer axially spaced seal portions relative to a liner about said shaft enabling said second portion of said air to flow into the inner barrel through said outer seal of the cushion, at least said outer seal comprising a labyrinth seal including an air passage hole and sealing teeth.

6. A system according to claim 1 wherein said seals have inner and outer axially spaced seal portions relative to a liner about said shaft enabling said second portion of said air to flow into the inner barrel through said outer seal of said cushion, said inner and outer seals including labyrinth teeth for defining a channel between the inner and outer labyrinth seals for containing pressurized air to minimize contamination of the outer seal by contact with oil.

* * * * *

UNITED STATES PATENT AND TRADEMARK OFFICE

CERTIFICATE OF CORRECTION

PATENT NO. : 6,932,349 B2
DATED : August 23, 2005
INVENTOR(S) : Alessandro Coppola It is certified that error appears in the above-identified patent and that said Letters Patent is hereby corrected as shown below:

Column 3,
Line 60, delete "," after "electromechanical".

Column 4,
Line 50, delete "he" and insert -- the --.
Line 52, delete "the air-choking choking" and insert -- an air-choking --.

Signed and Sealed this

Fourteenth Day of March, 2006

JON W. DUDAS
*Director of the United States Patent and Trademark Office*